US010465940B2

(12) United States Patent
Mun et al.

(10) Patent No.: US 10,465,940 B2
(45) Date of Patent: Nov. 5, 2019

(54) AIR DISCHARGE DEVICE AND AIR CONDITIONER HAVING THE SAME

(71) Applicant: LG ELECTRONICS INC., Seoul (KR)

(72) Inventors: Seongkuk Mun, Seoul (KR); Sungwoo Song, Seoul (KR); Sungjin Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 198 days.

(21) Appl. No.: 14/984,090

(22) Filed: Dec. 30, 2015

(65) Prior Publication Data

US 2016/0187024 A1 Jun. 30, 2016

(30) Foreign Application Priority Data

Dec. 31, 2014 (KR) ..... 10-2014-0195849

(51) Int. Cl.
*F24F 13/10* (2006.01)
*F24F 13/14* (2006.01)
*F24F 13/06* (2006.01)

(52) U.S. Cl.
CPC ..... *F24F 13/10* (2013.01); *F24F 13/06* (2013.01); *F24F 13/1413* (2013.01); *F24F 2013/1433* (2013.01)

(58) Field of Classification Search
CPC combination set(s) only.
See application file for complete search history.

(56) References Cited

U.S. PATENT DOCUMENTS 2,293,065 A * 8/1942 Kiczales ..... F24F 13/15 454/335
5,810,659 A * 9/1998 Kim ..... F24F 13/06 454/233

(Continued)

FOREIGN PATENT DOCUMENTS

CN 201103076 8/2008
CN 201740121 2/2011

(Continued)

OTHER PUBLICATIONS

KR20130107535MT; machine translation of KR20130107535A.*

(Continued)

*Primary Examiner* — Gregory L Huson
*Assistant Examiner* — Elizabeth M. May
(74) *Attorney, Agent, or Firm* — Ked & Associates LLP

(57) ABSTRACT

An air discharge device installed in an air conditioner to discharge and guide air air-conditioned in the air conditioner to an outside is provided. The air discharge device may include a first outer body having an air discharge grill; a second outer body coupled to a first side of the first outer body; a third outer body coupled to a second side of the first outer body and coupled with the second outer body; a first inner guide having an inner opening that faces the air discharge grill; and a second inner guide coupled with the first inner guide, and together with the first inner guide, forming an internal flow path. The first outer body, the second outer body, and the third outer body may be coupled with one another into a shape of a hollow cylinder.

27 Claims, 10 Drawing Sheets

(56) References Cited

U.S. PATENT DOCUMENTS

| | | | | |
|---|---|---|---|---|
| 5,868,617 | A * | 2/1999 | Kim | F24F 1/0007 454/233 |
| 2006/0199515 | A1* | 9/2006 | Lasko | F24F 7/065 454/237 |
| 2014/0308887 | A1* | 10/2014 | Yoon | F24F 13/08 454/284 |

FOREIGN PATENT DOCUMENTS

| | | |
|---|---|---|
| CN | 102032657 | 4/2011 |
| CN | 202734059 | 2/2013 |
| CN | 203708732 | 7/2014 |
| JP | 5-180473 | 7/1993 |
| KR | 10-1999-0041499 | 6/1999 |
| KR | 20090017289 A * | 2/2009 |
| KR | 10-2012-0025689 | 3/2012 |
| KR | 10-2013-0107535 | 10/2013 |
| KR | 10-1340526 | 12/2013 |
| WO | WO 2013/141513 | 9/2013 |

OTHER PUBLICATIONS

KR20090017289MT; machine translation of KR20090017289A.*
European Search Report dated May 3, 2016 issued in Application No. 15 20 0911.4.
Chinese Office Action dated Sep. 5, 2018 with English Translation.

* cited by examiner

AIR DISCHARGE DEVICE AND AIR CONDITIONER HAVING THE SAME

CROSS-REFERENCE TO RELATED APPLICATION

This application claims priority under 35 U.S.C. § 119 to Korean Application No. 10-2014-0195849, filed in Korea on Dec. 31, 2014, whose entire disclosure is hereby incorporated by reference.

BACKGROUND

1. Field

An air discharge device and an air conditioner having the same are disclosed herein.

2. Background

Air conditioners are appliances that suction in air, change a temperature, moisture, or cleanness of the air, and then discharge the air to the outside. An air conditioner may include a cooler or heater that changes an indoor temperature, a humidifier or dehumidifier that changes an indoor humidity, and an air purifier that changes indoor air cleanness.

An air conditioner may include an air conditioning unit or device that changes the temperature, humidity, or cleanness of the air, and a blower that blows the air into the air conditioning device. The air conditioning device may be a heat exchanger or a filter, for example.

An air conditioner may have an air discharging body, such as a header or a diffuser. The air may be changed in at least one of its temperature, humidity, or cleanness inside of the air conditioner and may be then discharged via the air discharging body to the outside. The air discharging body may be elevatably or rotatably installed in the air conditioner.

Korean Patent No. 10-1340526B1 (hereinafter "prior art"), published on Dec. 11, 2013 and incorporated herein by reference, discloses an air conditioner having a rotatably disposed head. According to the prior art, the head of the air conditioner has a cylindrical head main frame that forms an outer periphery thereof and is formed of a single member. Accordingly, the prior art air conditioner has many limitations in shape or size of its air discharge grill.

BRIEF DESCRIPTION OF THE DRAWINGS

Embodiments will be described in detail with reference to the following drawings in which like reference numerals refer to like elements, and wherein.

DETAILED DESCRIPTION

Figure 1:
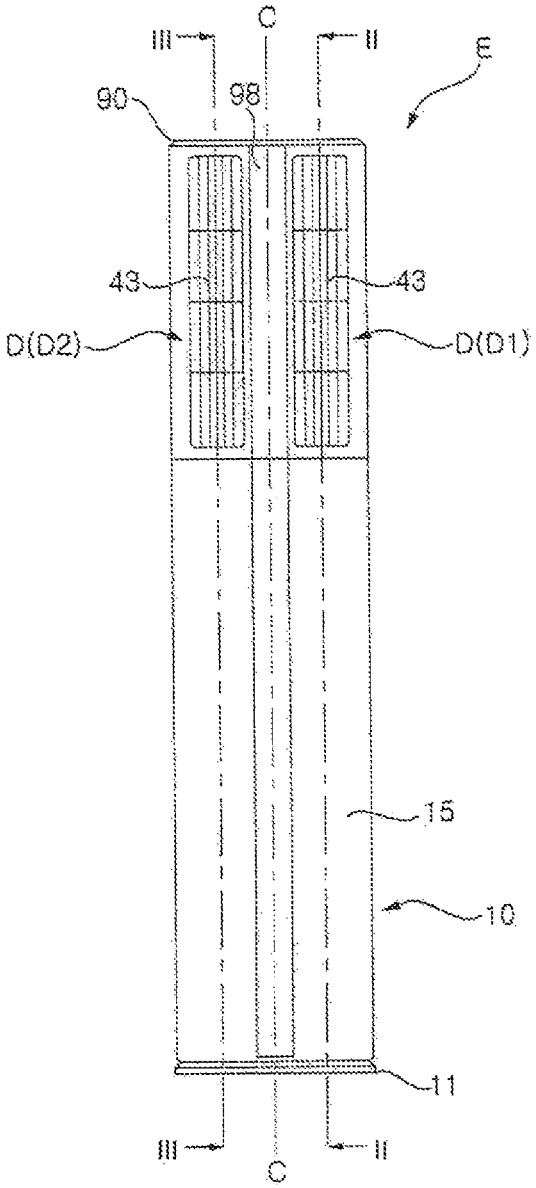
FIG. 1 is a front view of an air discharge device and an air conditioner having the same according to an embodiment.
Figure 2:
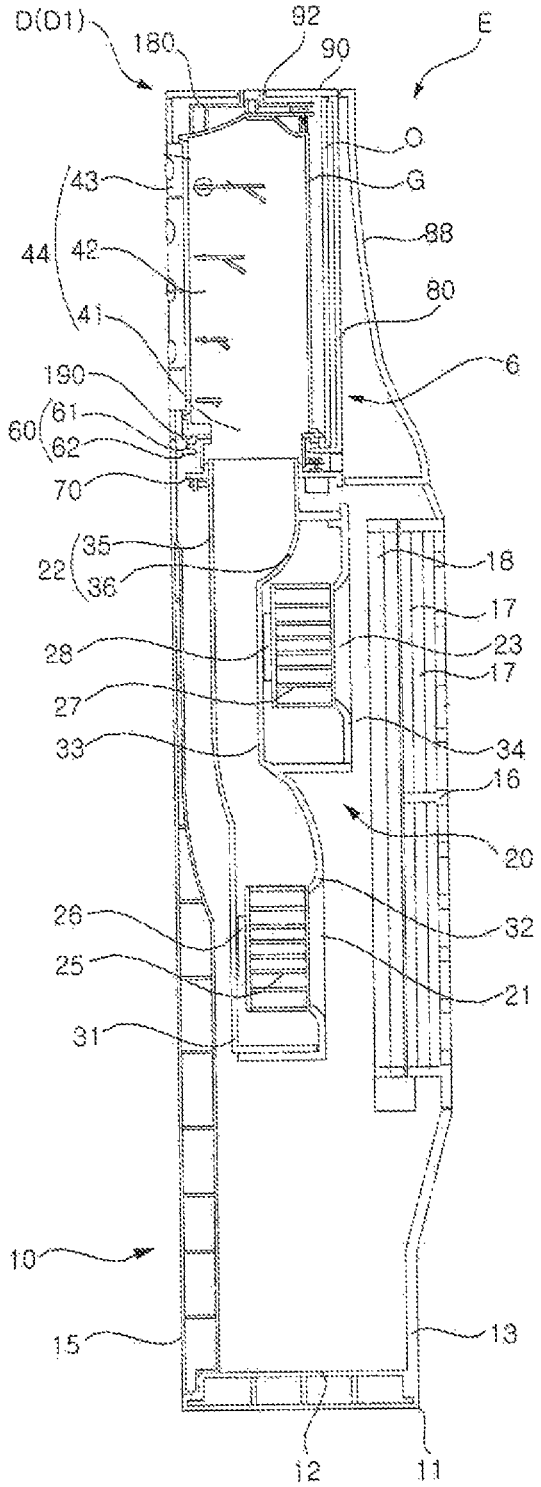
FIG. 2 is a cross-sectional view taken along line II-II of FIG. 1.
Figure 3:
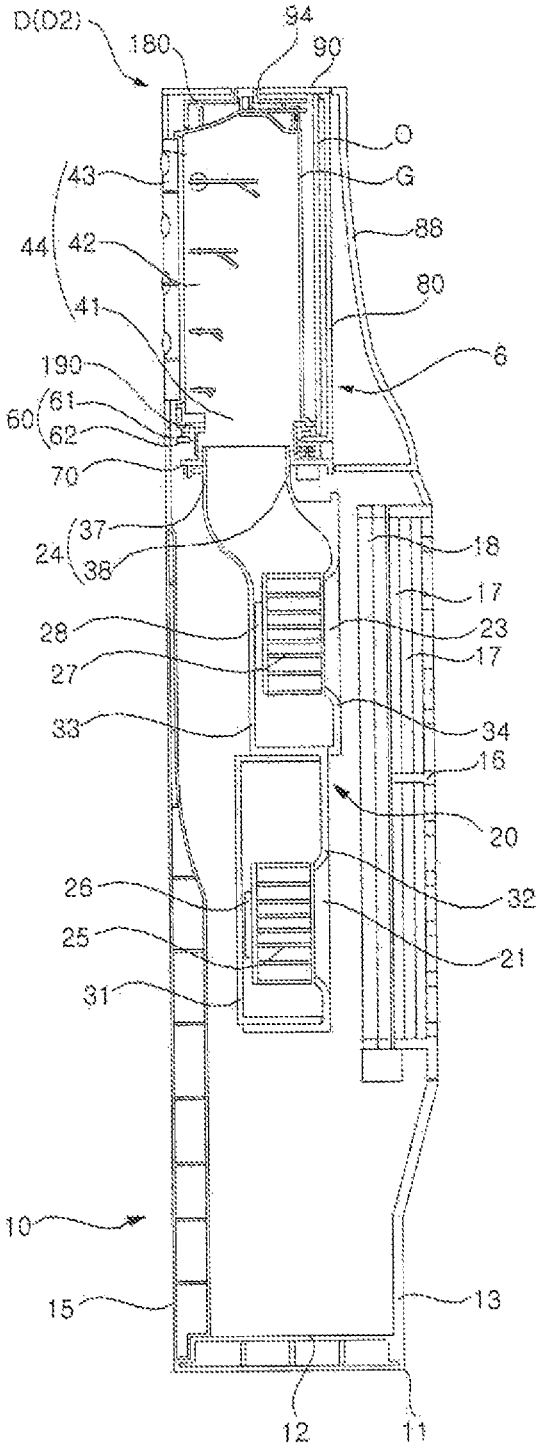
FIG. 3 is a cross-sectional view taken along line III-III of FIG. 1.
Figure 4:
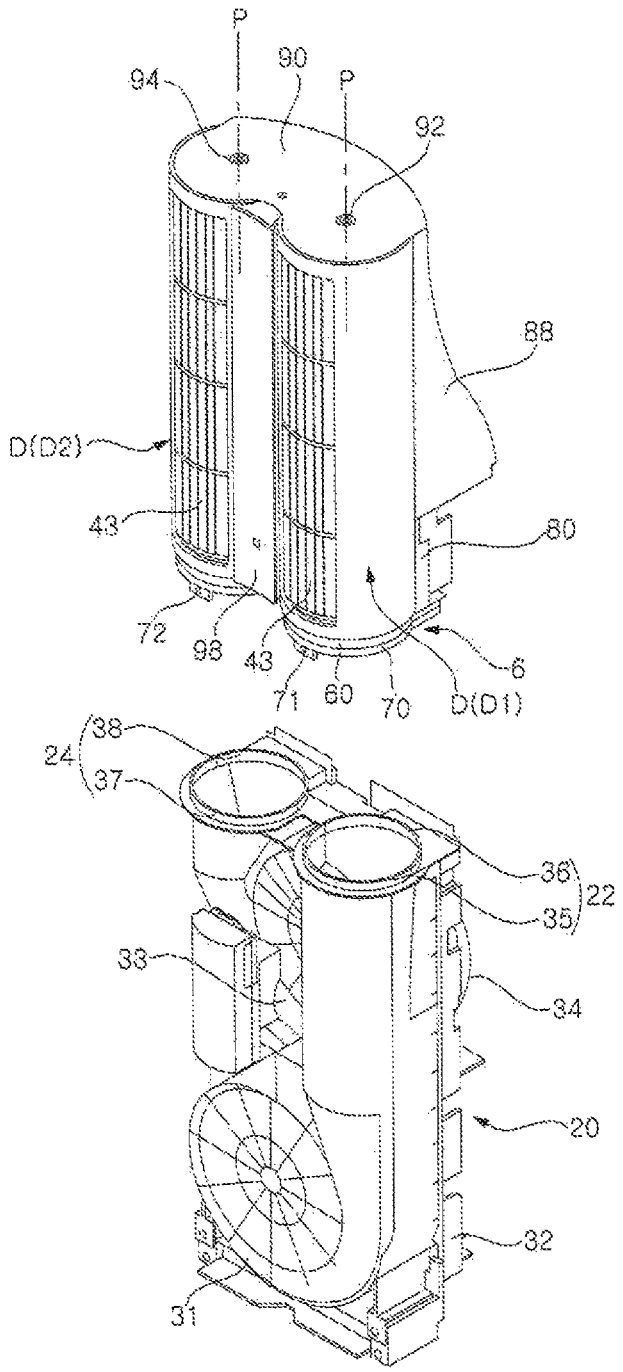
FIG. 4 is a perspective view illustrating the air discharge device shown in FIGS. 2 and 3 and a blower, which are separated from each other, according to an embodiment.
Figure 5:
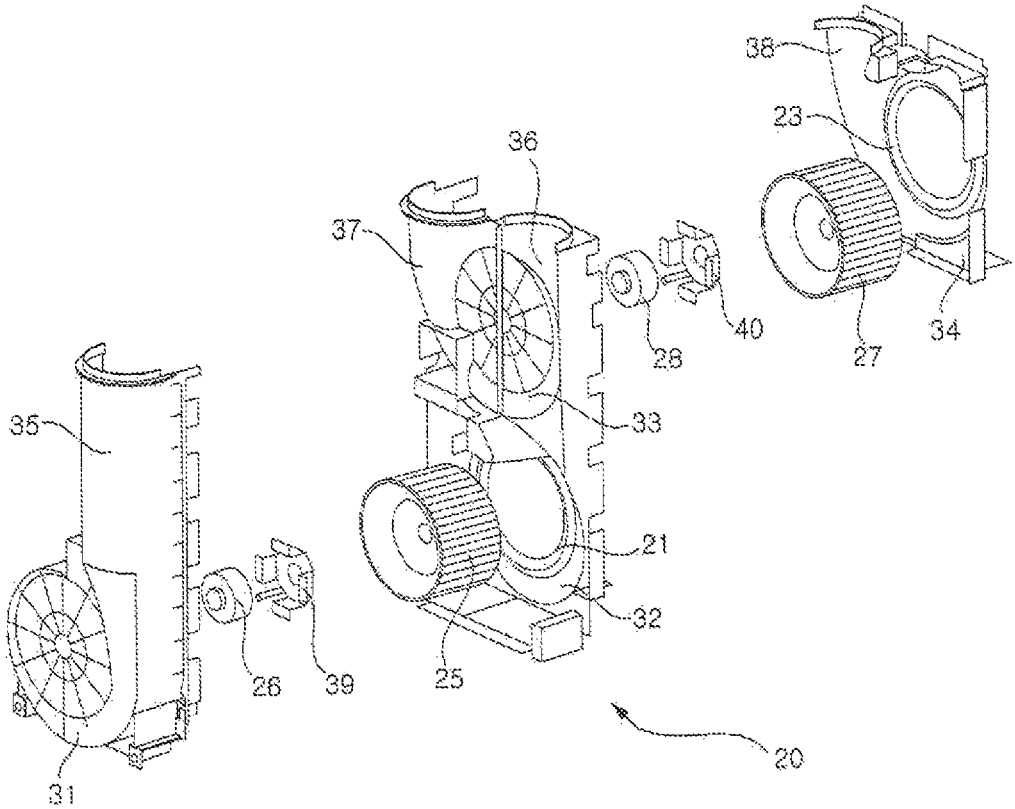
FIG. 5 is an exploded perspective view of the blower of FIGS. 2 to 4.

FIG. 1 is a front view of an air discharge device and an air conditioner having the same according to an embodiment. FIG. 2 is a cross-sectional view taken along line II-II of FIG. 1. FIG. 3 is a cross-sectional view taken along line III-III of FIG. 1. FIG. 4 is a perspective view illustrating the air discharge device shown in FIGS. 2 and 3 and a blower, which are separated from each other, according to an embodiment. FIG. 5 is an exploded perspective view of the blower of FIGS. 2 to 4.

Air discharging unit or device D may be provided in air conditioner E to guide and discharge air from an inside of the air conditioner E to an outside thereof. Each air discharge device D may be installed to be rotatable with respect to a vertical center axis P (see FIG. 4). Further, each air discharge device D may vary a discharged air flow by rotating to the left and right with respect to the vertical center axis P.

A single or multiple air discharge devices D may be provided in the air conditioner E. In a case in which a plurality of air discharge devices D is provided in the air conditioner E, the plurality of air discharge devices D may be spaced apart from each other in a horizontal direction.

The air conditioner E may include an air discharge device holder 6 that maintains the air discharge device D in position, as shown in FIGS. 2 to 4. The air discharge device D may be at least partially accommodated in the air discharge device holder 6. The air discharge device holder 6 may be mounted in blower 20 and may support the air discharge device D. A load of the air discharge device holder 6 may be exerted through the air discharge device holder 6 to the blower 20. The air discharge device holder 6 may rotatably support the air discharge device D. The air discharge device D may be rotated with respect to the rotational center axis P, while at least partially accommodated in the air discharge device holder 6.

The air discharge device D may discharge and guide air blown by the blower 20 to the outside. The air discharge device D may have an air inlet 41, through which the air blown by the blower 20 may be introduced to an inside of the air discharge device D, an internal flow path 42 that guides the air introduced through the air inlet 41, and an air outlet 43, through which the air having passed through the internal flow path 42 may be discharged outside of the air discharge device D. The air inlet 41, the internal flow path 42, and the air outlet 43 may form an air discharge flow path 44 of the air discharge device D. The air blown by the blower 20 may be introduced through the air inlet 41 to the internal flow path 42 and the air may then be discharged from the internal flow path 42 through the air outlet 43 to the outside.

A plurality of air discharge devices D may be provided in one air discharge device holder 6, spaced apart from each other. In this case, a first air discharge device D1 may be positioned at a first side of the air discharge device holder 6 while a second air discharge device D2 may be positioned at a second side of the air discharge device holder 6. The first air discharge device D1 and the second air discharge device D2 may be spaced apart from each other in a horizontal direction. The first discharge device D1 and the second air discharge device D2 may receive the air blown from the blower 20 and distributively discharge the air to the outside, while positioned in parallel with each other. The first air discharge device D1 and the second air discharge device D2 may be spaced apart from each other in a lateral direction or to the left and right in the air conditioner E. One of the first air discharge device D1 and the second air discharge device D2 may be a first or left-hand air discharge device positioned at a first or left side of the air discharge device holder 6, and the other of the first air discharge device D1 and the second air discharge device D2 may be a second or right-hand air discharge device positioned at a second or right side of the air discharge device holder 6. The first air discharge device D1 and the second air discharge device D2 may be installed to be positioned at first and second or left and right sides with respect to a central line C of the air conditioner E. One of the first air discharge device D1 and the second air discharge device D2 may be a first or left-hand air discharge device positioned at the first or left side of the central line C of the air conditioner E. The other of the first air discharge device D1 and the second air discharge device D2 may be a second or right-hand air discharge device positioned at the second or right side of the central line C of the air conditioner E. The first air discharge device D1 and the second air discharge device D2 may have a same configuration and different positions. Hereinafter, the first air discharge device D1 and the second air discharge device D2 are collectively referred to as an air discharge device D when their common structures are described, and are separately denoted so when distinctions therebetween are described.

The air conditioner E may further include a casing 10 that forms an outer appearance thereof, and the blower 20 that blows air to the air discharge device D. The casing 10 may include a base 11. The base 11 may have a stereoscopic shape with open front and top surfaces. The base 11 may include a lower frame 12 and a rear plate 13 formed on the lower frame 12. The rear plate 13 may extend vertically at a rear portion of the lower frame 12.

The casing 10 may further include a front cover 15. The front cover 15 may be provided to cover a front side of the blower 20. A bottom of the front cover 15 may be mounted on the lower frame 12 of the base 11. The front cover 15 may be provided at the lower frame 12 to shield a portion of the lower frame 12.

The casing 10 may include a suction inlet 16, through which air may be suctioned into the inside of the air conditioner E. The suction inlet 16 may be an air inlet through which air may be suctioned into an inside of the casing 10. The suction inlet 16 may be provided at a top of the base 11. The suction inlet 16 may be provided at a top of the rear plate 13 of the base 11. The suction inlet 16 may extend to lengthwise in a vertical direction at the top of the rear plate 13 of the base 11. The suction inlet 16 may include a purifying unit or device 17 that purifies the air suctioned into the air conditioner E. The purifying device 17 may include a filter that filters foreign bodies from the air passing therethrough. The purifying device 17 may include an electric dust collector that attracts and collects dust from air by electrification. The purifying device 17 may include an ion generator that generates ions in the air.

The air conditioner E may include a heat exchanger 18 provided inside of the casing 10 to exchange heat between the air and a coolant. The heat exchanger 18 may be installed between the air inlet and the blower 20 to exchange heat between the air suctioned in through the air inlet and a coolant. The air, after passing through the heat exchanger 18, may be suctioned into the blower 20. The heat exchanger 18 may be positioned between the suction inlet 16 and the blower 20 in an air flow direction. The heat exchanger 18 may be vertically provided at a front side of the suction inlet 16. Air may be suctioned in from outside of the air conditioner E through the suction inlet 16 to the inside of the air conditioner E, and the air may then pass through the heat exchanger 18. After passing through the heat exchanger 18, the air may be suctioned into the blower 20 and may then be blown by the blower 20 to the air discharge device D.

In a case in which the air conditioner E includes a pair of air discharge devices D1 and D2, a portion of the air passing through the heat exchanger 18 may be blown to the first air discharge device D1, and a remainder may be blown to the second air discharge device D2. The air blown by the blower 20 may be distributed to the first air discharge device D1 and the second air discharge device D2, and the air distributed to the first air discharge device D1 and the second air discharge device D2 may be distributively discharged to the outside through the first air discharge device D1 and the second air discharge device D2.

Referring to FIGS. 2 to 5, the blower 20 may be installed inside of the casing 10. The blower 20 may be installed opposite at least a portion of the heat exchanger 18. The blower 20 may be positioned at a front side of the heat exchanger 18. The blower 20 may suction in air from a rear side thereof and blow the air in an upward direction. The air discharge device holder 6 may be mounted in the blower 20.

The blower 20 may include a first air discharge 22, through which air is blown to the air discharge flow path 44 of one of the first air discharge device D1 and the second air discharge device D2, and a second air discharge 24, through which air is blown to the air discharge flow path 44 of the other of the first air discharge device D1 and the second air discharge device D2. The blower 20 may distributively discharge the air suctioned in through a suction port to the first air discharge 22 and the second air discharge 24. The blower 20 may include a plurality of suction ports 21 and 23. The blower 2 may suction air in through the first suction port 21 of the plurality of suction ports 21 and 23 and then blow the air to the first air discharge 22 or may suck air through the second suction port 23 of the plurality of suction ports 21 and 23 and then blow the air to the second air discharge 24. In a case of having the plurality of suction port 21 and 23, the blower 20 may include a first air flow path, through which the air suctioned in through the first suction port 21 may be discharged to the first air discharge 22, and a second air flow path, through which the air suctioned in through the second suction port 23 may be discharged to the second air discharge 24. In the case of having the plurality of suction ports 21 and 23, the blower 20 may include a first blower 25 provided in the first air flow path and a first fan motor 26 that rotates the first blower 25, and a second blower 27 provided in the second air flow path, and a second fan motor 28 that rotates the second blower 27.

The blower 20 may include a first fan housing 31 having the first fan motor 26 mounted therein and surrounding the first blower 25, and a first orifice 32 coupled with the first fan housing 31 and having the first suction port 21 that guides air to the first blower 25. The first fan motor 26 may be mounted in the first fan housing 31 by a first fan motor mounter 39.

The blower 20 may include a second fan housing 33 having the second fan motor 28 mounted therein and surrounding the second blower 27, and a second orifice 34 coupled with the second fan housing 33 and having the second suction port 23 that guides air to the second blower 27. The second fan motor 28 may be mounted in the second fan housing 33 by a second fan motor mounter 40.

The first air discharge 22 may be formed by the first fan housing 31 and the second fan housing 33. The first fan housing 31 may include a first front duct 35 with an open rear surface, which may project in an upward direction and be provided at a front side of a portion of the second fan housing 33. The second fan housing 33 may include a first rear duct 36, which may be positioned at a rear side of the first front duct 35 and be recessed in a rearward direction. The first front duct 35 and the first rear duct 36 may guide the air blown by the first blower 25 to the first air discharge device D1. When the first fan housing 31 and the second fan housing 33 are coupled with each other so that the first front duct 35 is positioned at a front side of the first rear duct 36, the first front duct 35 and the first rear duct 36 may form a duct unit or device shaped as a hollow cylinder.

The second air discharge 24 may be positioned next to the first air discharge 22 in parallel with the first air discharge 22. The second air discharge 24 may be formed by the second fan housing 33 and the second orifice 34. The second fan housing 33 may include a second front duct 37 with an open rear surface, which may project in a frontward direction and be provided at a front side of a portion of the second orifice 34. The second orifice 34 may include a second rear duct 38, which may be positioned at a rear side of the second front duct 37 and be recessed in a rearward direction. The second front duct 37 and the second rear duct 38 may guide the air blown by the second blower 27 to the second air discharge device D2. When the second fan housing 33 and the second orifice 34 are coupled with each other so that the second front duct 37 is positioned at a front side of the second rear duct 38, the second front duct 37 and the second rear duct 38 may form a duct unit or device shaped as a hollow cylinder.

The air discharge device holder 6 may include a lower body 60 that supports a lower portion of the air discharge device D. The lower body 60 may rotatably support the lower portion of the air discharge device D. The air discharge device D may be seated on the lower body 60, and a load of the air discharge device D may act on the lower body 60.

The lower body 60 may be formed of a plurality of members. The lower body 60 may include a fixing ring 61 in a shape of a ring and in which the air discharge device D may be seated, and a lower plate 62 coupled with the fixing ring 61. The fixing ring 61 may be formed of metal, and the air discharge device D may be seated on the fixing ring 61 and rub against the fixing ring 61. The fixing ring 61 may be formed of aluminum. A Teflon coating layer may be formed on an outer surface of the fixing ring 61.

The lower plate 62 may be coupled with the fixing ring 61 by, for example, a screw or other connecting member. The fixing ring 61 may be seated on a ring-shaped fixing ring seat formed in the lower plate 62.

The air discharge device holder 6 may further include a lower cover 70 installed in the lower body 60. The lower cover 70 may be coupled to the lower body 60 to position itself at a lower portion of the lower body 60. The lower cover 70 may be coupled with the lower plate 62 by, for example, a screw or other connecting member. The lower cover 70 may be coupled to an upper portion of the blower 20, and the lower cover 70 may function as an air discharge device holder mounter that mounts the air discharge device holder 6 to the blower 20. The lower cover 70 may have at least one blower coupler coupled to the blower 20. The blower coupler may be coupled to the blower 20 by, for example, a screw or other connecting member. The lower cover 70 may include a plurality of blower couplers 71 and 72. The plurality of blower couplers 71 and 72 may include a first coupler 71 coupled to the first air discharge 22 of the blower 20 by, for example, a screw or other connecting member, and a second coupler 72 coupled to the second air discharge 24 of the blower 20 by, for example, a screw or other connecting member.

The air discharge device holder 6 may further include a rear body 80 that extends perpendicular with respect to the lower body 60 to accommodate the air discharge device D. The rear body 80 may rotatably accommodate the air discharge device D. The rear body 80 may be integrally formed with the lower body 60 at a rear side of the lower body 60. The rear body 80 may be formed separately from the lower body 60 and may be coupled with a rear portion of the lower body 60 by, for example, a connecting member, such as screws or hooks. The rear body 80 may be larger in size than a gap between a pair of air discharge devices D1 and D2. The rear body 80 may shield the gap between the pair of air discharge devices D1 and D2 behind the pair of air discharge devices D1 and D2.

The air discharge device holder 6 may further include a top cover 90, which may be coupled with the rear body 80 and positioned at an upper side of the air discharge device D. The top cover 90 may keep an upper portion of the air discharge device D in position. The top cover 90 may have an air discharge device position maintaining unit or device that maintains the air discharge device D in position. The top cover 90 may have axis supports 92 and 94 that rotatably support a rotational center axis of each air discharge device D, respectively. A number of the axis supports 92 and 94 may be the same as the number of air discharge devices D. In a case in which the air conditioner E includes the first air discharge device D1 and the second air discharge device D2, the axis supports 92 and 94 may include a first axis support 92 that rotatably supports a rotational center axis of the first air discharge device D1 and a second axis support 94 that rotatably supports a rotational center axis of the second air discharge device D2.

The overall air discharge device holder 6 may be positioned at a rear side and an upper side of the air discharge device D. The air discharge device holder 6 may surround a rear side and an upper side of the air discharge device D substantially in a shape of the letter "L."

In a case in which the air conditioner E includes a pair of air discharge devices D1 and D2, the air conditioner E may further include a center body 98, which may extend lengthwise in a vertical direction between the pair of air discharge devices D1 and D2 to cover the gap between the pair of air discharge devices D1 and D2. The center body 98 may be positioned at an upper side of the lower body 60. A portion of the center body 98 may be positioned at a lower side of the top cover 90, and the center body 98 may shield the gap between the pair of air discharge devices D1 and D2 between the lower body 60 and the top cover 90.

The air discharge device holder 6 may be shaped so that a first or left side surface and a front surface thereof are each open. The center body 98 may be installed in the air discharge device holder 6 to partition an inside of the air discharge device holder 6 to first and second or left and right sides. The air discharge device holder 6 and the center body 98 may function as a frame that may protect the air discharge device D while keeping the air discharge device D in position.

The air conditioner E may further include a rear cover 88, which may be positioned at a rear side of the rear body 80 and cover a rear surface of the rear body 80. The rear cover 88 may be provided at an upper side of the suction inlet 16.

The air discharge device D may be formed by an assembly of a plurality of members. The air discharge device D may include an outer body that forms an outer appearance thereof. The outer body may be outer body assembly O, which may be an assembly of a plurality of members. The air discharge device D may include an inner guide protected by the outer body assembly O, that guides air. The inner guide may be inner guide assembly G formed by an assembly of a plurality of members.

Figure 6:
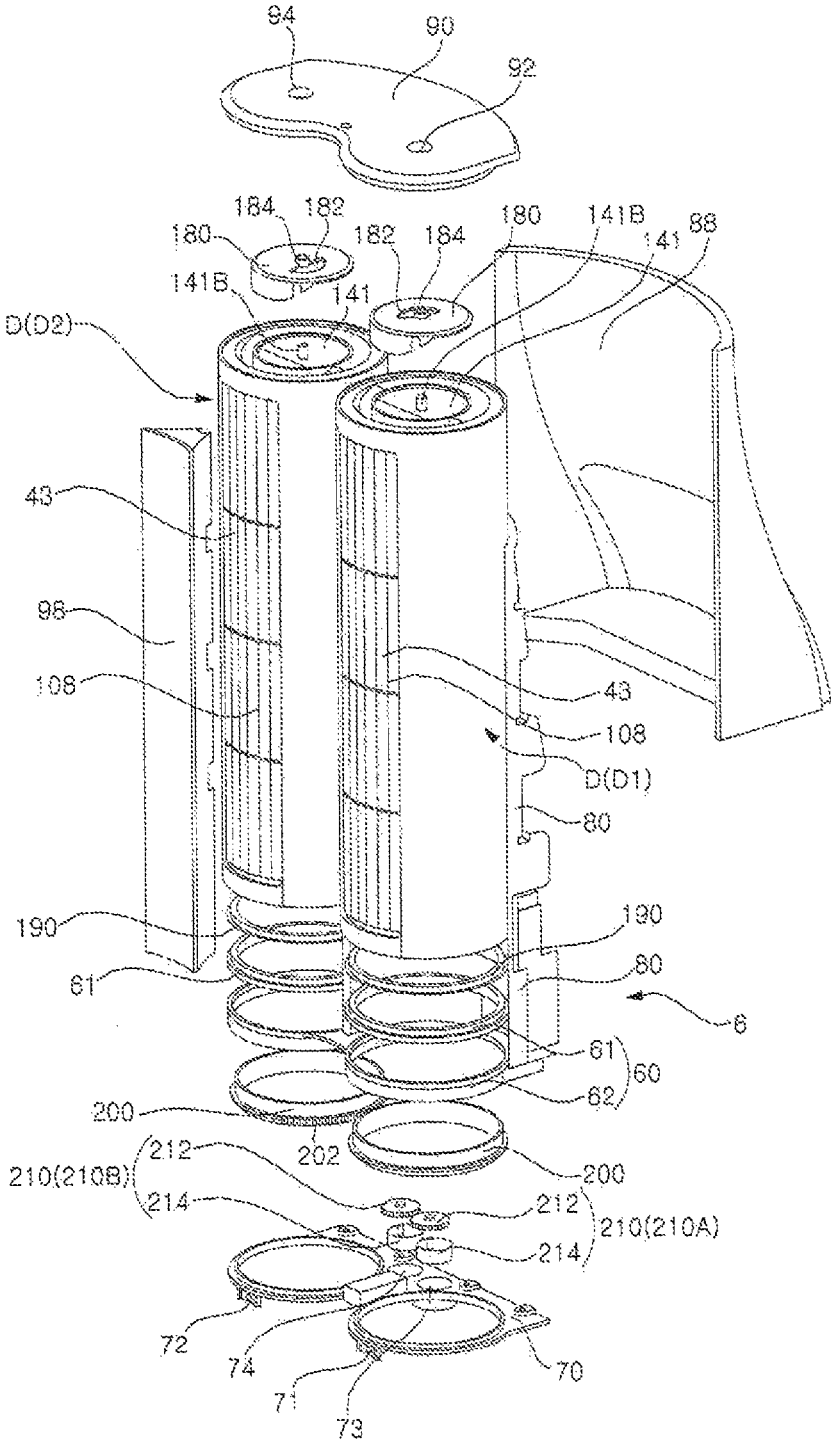
FIG. 6 is an exploded perspective view of an air discharge device and an air discharge device holder according to an embodiment.
Figure 7:
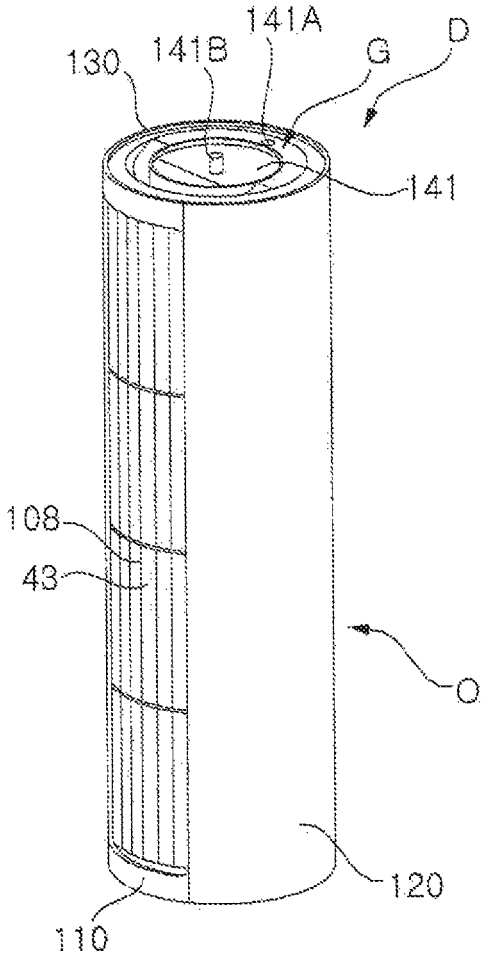
FIG. 7 is an expanded perspective view of an air discharge device according to an embodiment.
Figure 8:
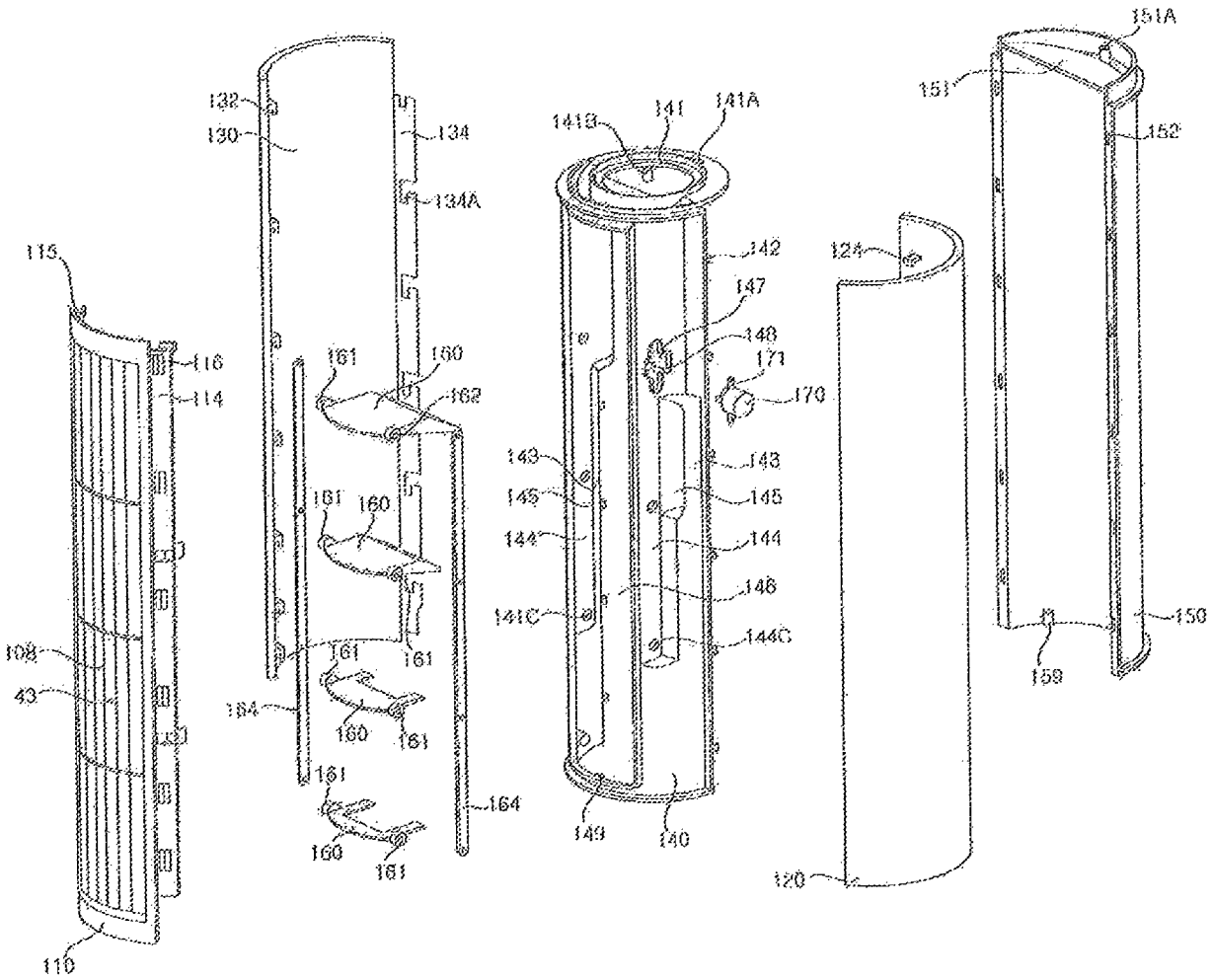
FIG. 8 is an expanded perspective view of an air discharge device according to an embodiment.
Figure 9:
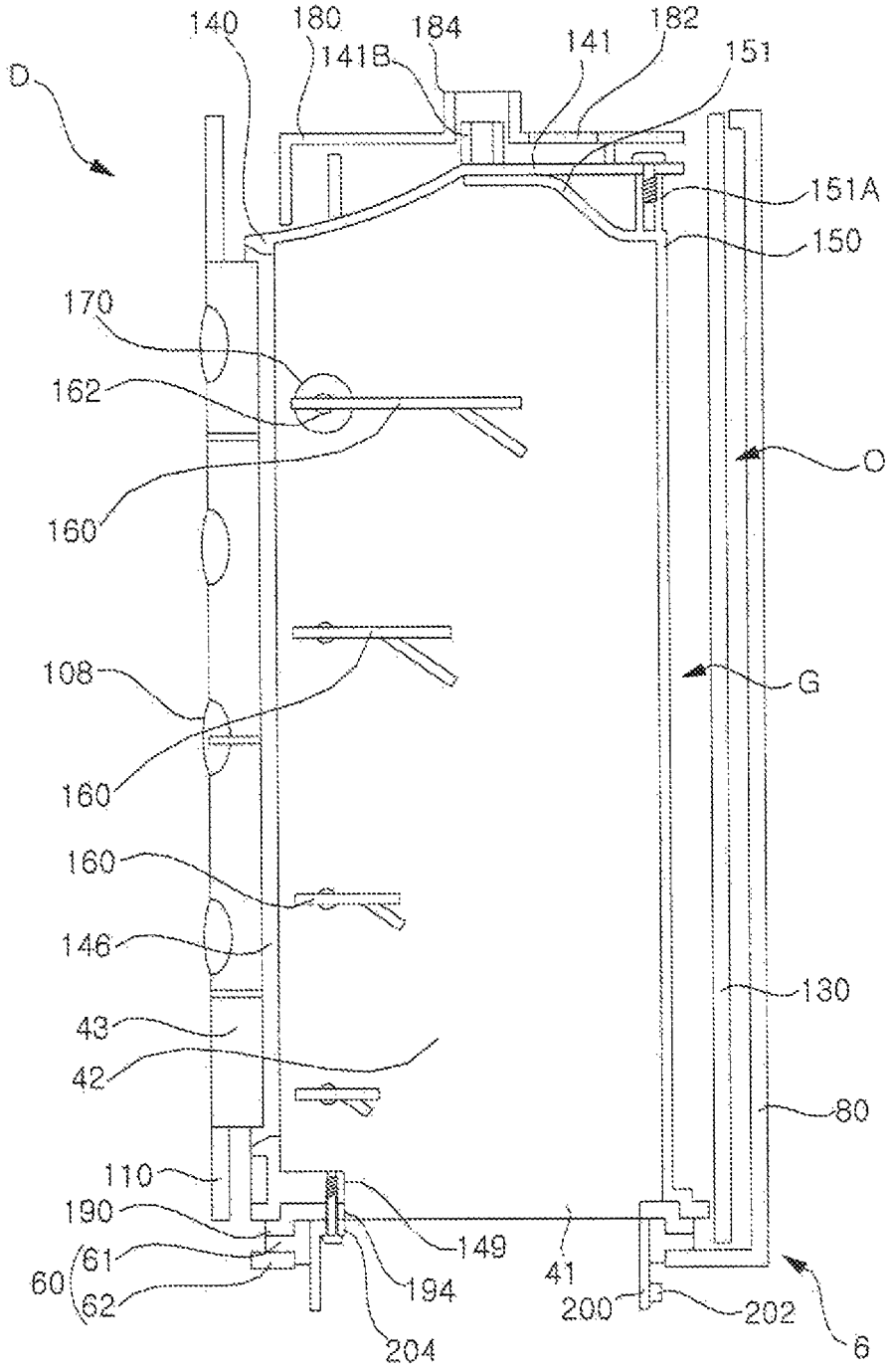
FIG. 9 is a longitudinal-sectional view of an air discharge device according to an embodiment.
Figure 10:
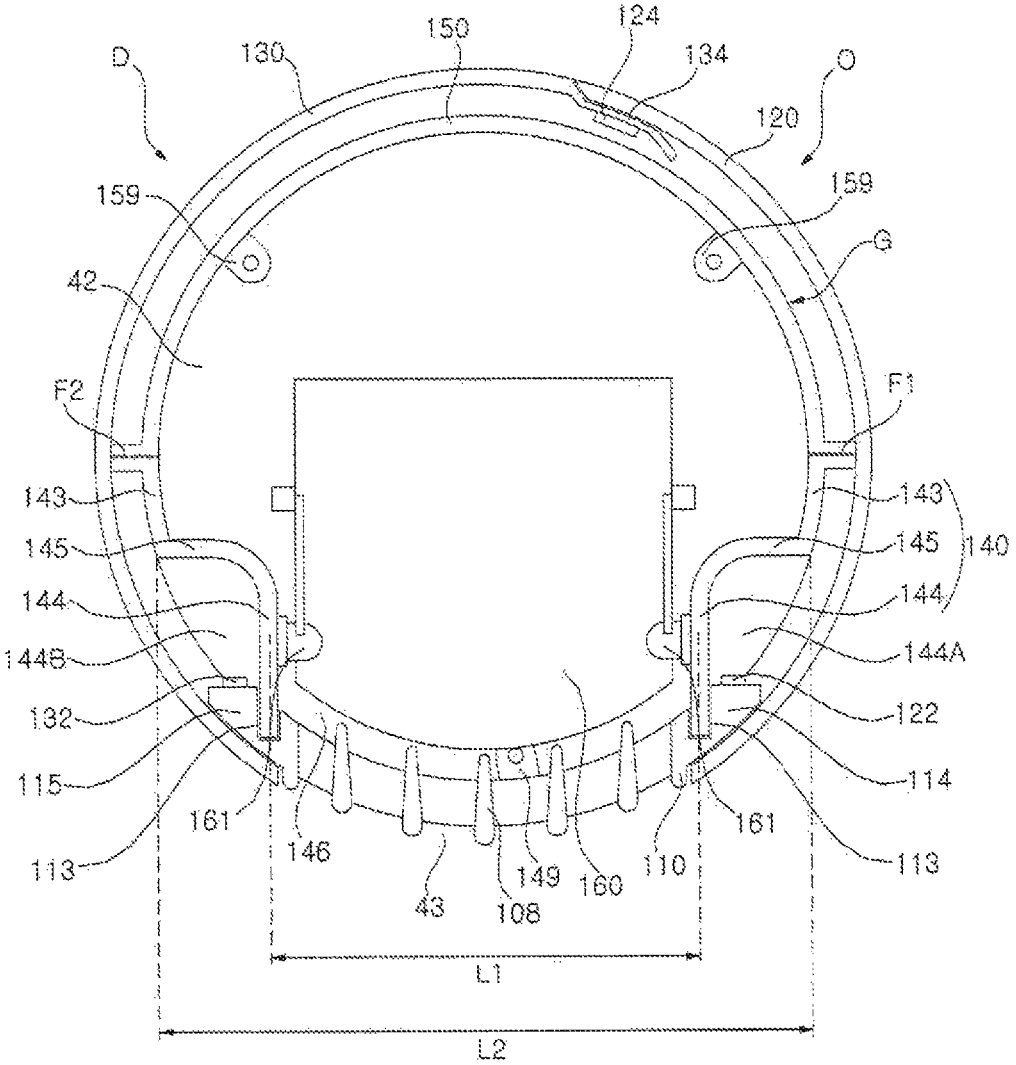
FIG. 10 is a cross-sectional view of an air discharge device according to an embodiment.

FIG. 6 is an exploded perspective view of an air discharge device and an air discharge device holder according to an embodiment. FIG. 7 is an expanded perspective view of an air discharge device according to an embodiment. FIG. 8 is an expanded perspective view of an air discharge device according to an embodiment. FIG. 9 is a longitudinal-sectional view illustrating an air discharge device according to an embodiment. FIG. 10 is a cross-sectional view of an air discharge device according to an embodiment.

The outer body assembly O may be shaped as a hollow cylinder, and the outer body assembly O may have an air discharge grill 108. The air discharge device D may include a first outer body 110 having the air discharging grill 108, a second outer body 120 coupled to a side of the first outer body 110, and a third outer body 130 coupled to another side of the first outer body 110 and coupled with the second outer body 120.

The air discharge device D may include a first inner guide 140 having an inner opening 146 opposite the air discharge grill 108, and a second inner guide 150 coupled with the first inner guide 140, and together with the first inner guide 140, forming the internal flow path 42. The air discharge device D may further include at least one wind direction adjuster 160 rotatably connected to the first inner guide 140. The air discharge device D may further include a wind direction adjuster motor 170 that rotates the at least one wind direction adjuster 160. As shown in FIGS. 6 and 9 the air discharge device D may also include a top cover 180 provided at an upper portion of at least one of the first inner guide 140 and the second inner guide 150, a lower ring 190 coupled with at least one of the first inner guide 140 or the second inner guide 150, and a gear member 200 coupled to the lower ring 190 and having a gear at an outer periphery thereof.

The air discharge device D will now be described hereinafter.

The first outer body 110, the second outer body 120, and the third outer body 130 may be coupled to form a hollow cylinder shape. The first outer body 110, the second outer body 120, and the third outer body 130 may form the hollow cylindrical outer body assembly O. The first outer body 110, the second outer body 120, and the third outer body 130 may form an outer periphery of the air discharge device D. The first outer body 110, the second outer body 120, and the third outer body 130 may be positioned outside of the inner guide assembly G to protect the inner guide assembly G. The first outer body 110, the second outer body 120, and the third outer body 130 may surround an outer periphery of the inner guide assembly G.

In a case in which the outer body forming the outer appearance of the air discharge device D is formed of a single member and shaped as a hollow cylinder, the single hollow cylindrical member may be partially deformed in shape, rendering it difficult to maintain the hollow cylinder shape thereof. In a case in which the single hollow cylindrical member includes an air discharge grill, many limitations may be imposed on a size or shape of the air discharging grill. In a case in which the single hollow cylindrical member forms the outer body, it may be not easy to assemble the inner guide assembly G.

In contrast, if the outer body assembly O is formed of an assembly of the first outer body 110, the second outer body 120, and the third outer body 130, the hollow cylinder shape is less likely to be deformed, and the air discharge grill 108 may be manufactured in various sizes or shapes, and the inner guide assembly G may be subject to easy assembly.

The first outer body 110, the second outer body 120, and the third outer body 130, each, may have an arc-shaped cross section. The first outer body 110, the second outer body 120, and the third outer body 130, each, may extend lengthwise in a vertical direction. The outer body assembly O, an assembly of the first outer body 110, the second outer body 120, and the third outer body 130, may have a hollow cylinder shape which may extend lengthwise in a vertical direction.

The first outer body 110 may be a front outer body that forms a front portion of the air discharge device D. The air discharge grill 108 may be integrally formed with the first outer body 110, forming a portion of the first outer body 110. In manufacturing the first outer body 110, the air discharge grill 108 and the front outer body may be manufactured separately from each other and may then be coupled with each other by, for example, a hook, screw, or other connecting member, so that the air discharge grill 108 may be positioned in an opening of the front outer body.

The second outer body 120 may be a first or left-hand rear body that forms the outer appearance of the first or left portion of the air discharge device D and the outer appearance of a portion of the rear portion of the air discharge device D. The second outer body 120 may be coupled to the first or left portion of the first outer body 110 and a rear end of the third outer body 130.

The third outer body 130 may be a second or right-hand rear body that forms the outer appearance of a second or right portion of the air discharge device D and the outer appearance of the rest of the rear portion of the air discharge device D. The third outer body 130 may be coupled to the second or right portion of the first outer body 110 and a rear end of the second outer body 120.

At least one of the first outer body 110, the second outer body 120, or the third outer body 130 may have a fitting hole 113, into which one of the first inner guide 140 and the second inner guide 150 may be inserted and fitted. The first inner guide 140 may be positioned closer to the first outer body 110 than the second inner guide 150. The first outer body 110 may have the fitting hole 113, into which the first inner guide 140 may be inserted and fitted. A tip of a front flow path 144, which will be described hereinafter, may be inserted and fitted into the fitting hole 113 of the first outer body 110.

The first outer body 110 may further include a first or left detachable part or portion 114 detachably coupled with the second outer body 120 and a second or right detachable part or portion 115 detachably coupled with the third outer body 130. One of the second outer body 120 or the first detachable portion 114 may have at least one hook 122, and the other may have at least one hook hole 116, into which the at least one hook 122 may be inserted and hooked. In a case in which the at least one hook 122 is formed in the second outer body 120, the first detachable portion 114 may have the at least one hook hole 116 into which the at least one hook 122 may be inserted and hooked. The second outer body 120, when the at least one hook 122 is inserted and hooked into the at least one hook hole 116, may block a front side of the first detachable portion 114. The second outer body 120 may partially overlap the first detachable portion 114, and the first detachable portion 114 may be shielded and protected by the second outer body 120.

One of the third outer body 130 or the second detachable portion 115 may have at least one hook 132, and the other may have at least one hook hole (not shown), into which the at least one hook 132 may be inserted and hooked. In a case in which the at least one hook 132 is formed in the third outer body 130, the second detachable portion 115 may have at least one hook hole, into which the at least one hook 132 may be inserted and hooked. The third outer body 130, when the at least one hook 132 is inserted and hooked into the at least one hook hole, may block a front side of the second detachable portion 115. The third outer body 130 may partially overlap the second detachable portion 115, and the second detachable portion 115 may be shielded and protected by the third outer body 130.

One of the second outer body 120 or the third outer body 130 may have at least one hook 124, and the other may have a hooked part or portion 134, into which the hook 124 may be inserted and hooked. The hook portion 134 may include a hook indent 134A, into which the at least one hook 124 may be inserted from a side thereof and hooked. The hook portion 134 may be bent inwards to be blocked by the second outer body 120 or the third outer body 130 when the second outer body 120 and the third outer body 130 are coupled with each other. In a case in which the hook portion 134 is formed in the third outer body 130, the second outer body 120 may be positioned to partially overlap the hook portion 134 and to block the hook portion 134. In a case in which the hook portion 134 is formed in the second outer body 120, the third outer body 130 may be positioned to partially overlap the hook portion 134 and block the hook portion 134.

The first inner guide 140 and the second inner guide 150 may be coupled in a shape of a hollow cylinder. The first inner guide 140 and the second inner guide 150 may form an inner periphery of the air discharge device D. The first inner guide 140 and the second inner guide 150 may guide air from inside of the outer body assembly O to the air discharge grill 108 and may be protected by the outer body assembly O.

The first inner guide 140 and the second inner guide 150, when coupled with each other, may form a hollow cylinder shape with an open bottom and closed top and with the inner opening 146 opened to a portion of a periphery thereof. The first inner guide 140 and the second inner guide 150, each, may be formed lengthwise in a vertical direction. The inner guide assembly G, an assembly of the first inner guide 140 and the second inner guide 150, may have a hollow cylinder shape which extends lengthwise in a vertical direction.

Air may be introduced into an inside of the inner guide assembly G through a space between a lower portion of the first inner guide 140 and a lower portion of the second inner guide 150 and may ascend along the inner guide assembly G. The first inner guide 140 and the second inner guide 150 may form the air inlet 41 of the air discharge device D. The air inlet 41 may be formed between the lower portion of the first inner guide 140 and the lower portion of the second inner guide 150.

The first inner guide 140 and the second inner guide 150 may form the internal flow path 42. The internal flow path 42 may be formed between the first inner guide 140 and the second inner guide 150. The air guided to the internal flow path 42 may be discharged through the inner opening 146 of the first inner guide 140 to the air discharge grill 108, and may then be discharged through the air discharge grill 108 outside of the air discharge device D.

The first inner guide 140 may be provided closer to the air discharge grill 108 than the second inner guide 150. The first inner guide 140 may be a front inner guide. The second inner guide 150 may be positioned behind the first inner guide 140, and the second inner guide 150 may be a rear inner guide.

Boundaries F1 and F2 between the first inner guide 140 and the second inner guide 150 may face an inner surface of the second outer body 120 and an inner surface of the third outer body 130. An outer surface of the second inner guide 150 may face all of an inner surface of the first outer body 110, the inner surface of the second outer body 120, and the inner surface of the third outer body 130. An outer surface of the second inner guide 150 may face the inner surface of the second outer body 120 and the inner surface of the third outer body 130.

At least one of the first inner guide 140 or the second inner guide 150 may include a top plate. The first inner guide 140 and the second inner guide 150, each, may include a top plate. The first inner guide 140 may include a first top plate 141, and the second inner guide 150 may include a second top plate 151. The first top plate 141 may cover the second top plate 151 and may be coupled with the second top plate 151. The first top plate 141 may have a connecting member through hole 141A, through which a connecting member, such as a screw, may pass, and the second top plate 151 may have a projecting connecting boss 151A, to which the connecting member, such as a screw, passing through the connecting member through hole 141A may be connected. The first top plate 141 may have a protrusion 141B, which may serve as a rotational center axis of the air discharge device D.

The first inner guide 140 may be coupled with the second inner guide 150. One of the first inner guide 140 or the second inner guide 150 may have at least one projecting hook 142, and the other may have at least one hook hole 152, into which at least one hook 142 may be inserted and hooked.

The first inner guide 140 may collect air and guide the air to the air discharge grill 108. A left-right or lateral width L1 of a front portion of the first inner guide 140 may be smaller than a left-right or lateral width L2 of a rear portion of the first inner guide 140.

The first inner guide 140 may further include a rear flow path 143, a front flow path 144, and a connecting part or portion 145 that connects the rear flow path 143 with the front flow path 144. The rear flow path 143 may be formed at a rear portion of the first inner guide 140. The rear flow path 143 may include a pair of side plates that extend lengthwise in a vertical direction and spaced apart from each other in a lateral or left and right direction. The pair of side plates of the rear flow path 143 may face each other in the lateral or left and right direction. Air may be guided from the internal flow path 42 through the pair of side plates to the front flow path 144. The pair of side plates of the rear flow path 143 may be formed to be rounded or inclined.

The front flow path 144 may be positioned closer to the air discharge grill 108 than the rear flow path 143. The front flow path 144 may be formed at a front portion of the first inner guide 140. The front flow path 144 may include a pair of side plates that extend lengthwise in a vertical direction and spaced apart from each other in a lateral or left and right direction. The pair of side plates of the front flow path 144 may face each other in the lateral or left and right direction. The front flow path 144 may be smaller in a lateral or left-right width than the rear flow path 143. A distance between the pair of side plates of the front flow path 144 may be smaller than the distance between a pair of side plates of the rear flow path 143. The front flow path 144 may have the inner opening 146 for air passage therethrough. The inner opening 146 may be formed in the pair of side plates of the front flow path 144. The at least one wind direction adjuster 160 may be rotatably connected to the front flow path 144. The front flow path 144 may have at least one supporting hole 144C, in which a horizontal shaft of the at least one wind direction adjuster 160 may be rotatably supported.

The connecting portion 145 may extend perpendicular to the rear flow path 143 and the front flow path 144 each. The connecting portion 145 may extend lengthwise in a vertical direction.

The first inner guide 140 may have a motor installation part or portion 147 at or to which the wind direction adjuster motor 170 may be installed. The motor installation portion 147 may be formed to project to the inner opening 146. The motor installation portion 147 may have a rotational shaft through hole 148, through which a rotational shaft 171 of the wind direction adjuster motor 170 may rotatably pass. The motor installation portion 147 may face the inner surface of one of the second outer body 120 or the third outer body 130, and the motor installation portion 147 may be blocked by the second outer body 120 or the third outer body 130.

The first inner guide 140 may include a first or left recess 144A, which may be recessed to accommodate the first detachable portion 114 and a second or right recess 144B, which may be recessed to accommodate the second detachable portion 115. The first recess 144B may be shaped to be recessed at a first or left side portion of the first inner guide 140 by a bent structure of a first or left side portion of the front flow path 144 and a left or first side portion of the connecting portion 145. The second recess 144B may be shaped to be recessed at a second or right side portion of the first inner guide 140 by a bent structure of a second or right side portion of the front flow path 144 and a second or right side portion of the connecting portion 145. When the first inner guide 140 is inserted and fitted into the fitting hole 113, the first detachable portion 114 may be inserted and positioned in the first recess 144A, and the second detachable portion 115 may be inserted and positioned in the second recess 144B.

The first inner guide 140 may have a front connecting boss 149 at an inner periphery of a lower portion thereof. The lower ring 190 and the gear member 200 may be coupled to the front connecting boss 149 by, for example, a screw or other connecting member.

The second inner guide 150 may have a semi-circular cross section. The second inner guide 150 may have an open front surface and bottom surface. The second inner guide 150 may have a top surface which may be closed by the top plate 151. The second inner guide 150 may have at least one hook hole 152 at an edge that faces the first inner guide 140. The second inner guide 150 may have a rear connecting boss 159 at an inner periphery of a lower portion thereof. The lower ring 190 and the gear member 200 may be coupled to the rear connecting boss 159 by, for example, a screw or other connecting member.

The inner guide assembly G, when the first inner guide 140 and the second inner guide 150 are assembled, may be formed into a hollow cylinder shape having a closed top surface, the open inner opening 146 at a periphery thereof, and an open bottom, and may be shaped so that the first recess 144A and the second recess 144B are recessed.

Each at least one wind direction adjuster 160 may have a horizontal shaft rotatably connected to the first inner guide 140, and may be rotated about a center of the horizontal shaft in a vertical direction. A plurality of wind direction adjusters 160 may be installed in the first inner guide 140. The plurality of wind direction adjusters 160 may be connected via a connecting link 164, and as any one of the plurality of wind direction adjusters 160 rotates, the others may be rotated by the connecting link 164.

Each wind direction adjuster 160 may include a supporting shaft 161 rotatably supported by the first inner guide 140. The supporting shaft 161 may be formed in the wind direction adjuster 160, projecting in a horizontal direction. The supporting shaft 161 may function as the horizontal shaft. Any one of the plurality of wind direction adjusters 160 may include a rotational shaft connecting part or portion 162 connected to the rotational shaft 171 of the wind direction adjuster motor 170. The rotational shaft connecting portion 162 may project from any one of the plurality of wind direction adjusters 160 in a horizontal direction and may serve as the horizontal shaft.

The wind direction adjuster motor 170 may be installed in the first inner guide 140 and may rotate the at least one wind direction adjuster 160 so that the at least one wind direction adjuster 160 rotates about the supporting shaft 161 in a vertical direction. The wind direction adjuster motor 170 may rotate the at least one wind direction adjuster 160 connected thereto as the rotational shaft 171 is coupled to the connecting shaft 162 connected to the connecting shaft 162 formed in any one of the at least one wind direction adjuster 160.

The wind direction adjuster motor 170 may be connected with the connecting link 164 through an actuating link (not shown) to move the connecting link 164 in a vertical direction. The wind direction adjuster motor 170 may rotate the actuating link, and the actuating link may rotate about the wind direction adjuster motor 170 to ascend or descend the connecting link 164. One of the connecting link 164 and the actuating link may have a protrusion, and the other may have a long sliding guide hole along which the protrusion may slide and be guided.

The top cover 180 may be coupled with at least one of the top plate of the first inner guide 140 and the top plate of the second inner guide 150, as shown in FIG. 6. The top cover 180 may have a through hole 182, through which an electric wire connected to the wind direction adjuster motor 170 may pass. The top cover 180 may have a boss 184, which may project to surround an outer periphery of the protrusion 141B and protect the protrusion 141B.

The lower ring 190 may be formed of metal, and the lower ring 190 may be seated on the lower body 60 rubbing against the lower body 60. The lower ring 190 may be formed of steel. A Teflon coating layer may be formed on an outer surface of the lower ring 190.

In a case in which the lower ring 190 is not provided in the inner guide assembly G, the inner guide assembly G may be seated on the lower body 60 and rub against the lower body 60. In this case, the inner guide assembly G or the lower body 60 may be worn.

In contrast, in a case in which the lower ring 190 is seated on the lower body 60, the inner guide assembly G may not be brought into direct contact with the lower body 60, and thus, the inner guide assembly G or the lower body 60 does not experience wear which may occur when the inner guide assembly G rubs against the lower body 60. Accordingly, a life span of the air discharge device D may be maximized.

The lower ring 190 may be seated on the fixing ring 61 of the lower body 60, and when the air discharge device D rotates, the lower ring 190 may rub against the fixing ring 61. The lower ring 190 may have a connecting boss 194 with a connecting hole, through which a screw or other connecting member, for example, may pass, as shown in FIG. 9. A plurality of connecting bosses 194 may be formed at an inner periphery of the lower ring 190. Any one of the plurality of connecting bosses 194 may be connected with the front connecting boss 149 of the first inner guide 140 by, for example, a screw or other connecting member. Any one of the plurality of connecting bosses 194 may be connected with the rear connecting boss 159 of the second inner guide 150 by, for example, a screw or other connecting member.

The gear member 200 may have a gear 202 partially at an outer periphery thereof. The gear member 200 may be shaped as a ring. The gear member 200, together with the lower ring 190, may be coupled to the inner guide assembly G. The gear member 200 may have a connecting boss 204 with a connecting hole, through which a screw or other connecting member may pass, for example. The gear member 200 may have as many connecting bosses 204 as the number of connecting bosses 194 of the lower ring 190. A screw or other connecting member, for example, may sequentially pass through the connecting boss 204 of the gear member 200 and the connecting boss 194 of the lower ring 190 and may then be coupled to the front connecting boss 149 of the first inner guide 140 or the rear connecting boss 159 of the second inner guide 150. When the gear member 200 rotates, the gear member 200, the lower ring 190, and the inner guide assembly G may rotate about a same rotational center axis P, and in this case, the outer body assembly O may rotate along with the inner guide assembly G.

The air discharge device holder 6 may have an air discharge device rotating mechanism 210 that rotates the air discharge device D, as shown in FIG. 6. In a case in which the first air discharge device D1 and the second air discharge device D2 both are provided in the air discharge device holder 6, the air discharge device rotating mechanism 210 may include a first air discharge device rotating mechanism 210A that rotates the first air discharge device D1 and a second air discharge device rotating mechanism 210B that rotates the second air discharge device D2. The first air discharge device rotating mechanism 210A and the second air discharge device rotating mechanism 210B may have a same structure and different positions. Hereinafter, the first air discharge device rotating mechanism 210A and the second air discharge device rotating mechanism 210B may be collectively referred to as an air discharge device rotating mechanism 210 when describing the common structures thereof.

The air discharge device rotating mechanism 210 may include a drive gear 212, which may be engaged with the gear 202 of the gear member 200 to rotate the gear member 200, and a rotating motor 214 having a rotating shaft that rotates the drive gear 212. The rotating motor 214 may be mounted in the air discharge device holder 6. The rotating motor 214 may be installed in the lower cover 70 of the air discharge device holder 6. The lower cover 70 may have a rotating motor accommodating part or portion, into which the rotating motor 214 may be inserted and installed. A plurality of rotating motor accommodating portions may be formed in the lower cover 70. The lower cover 70 may have a first rotating motor accommodating portion 73, into which the rotating motor 214 of the first air discharge device rotating mechanism 210*a* may be installed, and a second rotating motor accommodating portion 74, into which the rotating motor 214 of the second air discharge device rotating mechanism 210B may be installed.

Hereinafter, assembly of the air discharge device D configured as discussed above will be described.

A worker may install the at least one wind direction adjuster 160 in the first inner guide 140 and mount the wind direction adjuster motor 170 in the first inner guide 140. The worker may insert the supporting shaft 161 of each of the at least one wind direction adjuster 160 into the supporting hole 144C of the first inner guide 140 by inserting the at least one wind direction adjuster 160 into the inside of the first inner guide 140, and the at least one wind direction adjuster 160 may be rotatably supported in the first inner guide 140.

The worker may insert the wind direction adjuster motor 170 from outside of the first inner guide 140 into the motor installing portion 147 and insert the rotational shaft 171 through the rotational shaft through hole 148. Upon insertion of the wind direction adjuster motor 170 as described above, the wind direction adjuster motor 170 may be positioned inside of the motor installing portion 147, and the worker may connect the wind direction adjuster motor 170 to the first inner guide 140 by, for example, a screw or other connecting member.

The worker may assemble the second inner guide 150 into the first inner guide 140 in which the at least one wind direction adjuster 160 and the at least one wind direction adjuster motor 170 have been installed. The at least one hook 142 formed in the first inner guide 140 may be inserted and hooked into the at least one hook hole 152 formed in the second inner guide 150. Upon assembly as discussed above, the first inner guide 140 and the second inner guide 150 may form a long hollow cylinder shape that extends in a vertical direction.

The worker may place the lower ring 190 and the gear member 200 at a lower portion of the inner guide assembly G, which is an assembly of the first inner guide 140 and the second inner guide 150, and may connect the gear member 200, the lower ring 190, and the inner guide assembly G by, for example, a screw or other connecting member.

The worker may position the first outer body 110 at a front side of the first inner guide 140 and may fit the first inner guide 140 into the at least one fitting hole 113 of the first outer body 110. A tip of the front flow path 144 of the first inner guide 140 may be inserted and fitted into the at least one fitting hole 113 of the first outer body 110, and in this case, the first outer body 110 may be assembled with the inner guide assembly G to form a single body. Thereafter, the worker may assemble the second outer body 120 and the third outer body 130 into the first outer body 110, with the second outer body 120 and the third outer body 130 positioned adjacent to the inner guide assembly G.

The worker may insert and hook the at least one hook 122 of the second outer body 120 into the at least one hook hole 116 of the first detachable portion 114 of the first outer body 110 and the at least one hook 132 of the second outer body 120 into the at least one hook hole 116 of the second detachable portion 115 of the first outer body 110. The worker may insert and hook the at least one hook 124 of one of the second outer body 120 and the third outer body 130 into the hooked portion 134 of the other of the second outer body 120 and the third outer body 130.

When assembling the first outer body 110, the second outer body 120, and the third outer body 130 as discussed above, the first outer body 110, the second outer body 120, and the third outer body 130 may be arranged in the shape of a hollow cylinder surrounding the outer periphery of the inner guide assembly G, and the assembly of the air discharge device D may be completed. The worker may seat the assembled air discharge device D onto the lower body 60.

Hereinafter, an operation of embodiments configured as discussed above will be described.

First, when the air conditioner E operates, the blower 20 may be actuated to allow air to sequentially pass from the outside through the suction inlet 16 to the heat exchanger 18. After passing through the heat exchanger 18, the air may be suctioned into the blower 20, and may then be blown from the blower 20 to the air discharge device D.

The air blown by the blower 20 may be introduced through the air inlet 41 of the air discharge device D to a space between the first inner guide 140 and the second inner guide 150 and may be guided to the internal flow path 42 between the first inner guide 140 and the second inner guide 150. The air guided to the internal flow path 42 may be directed to flow to the at least one wind direction adjuster 160 by the first inner guide 140 and a second inner guide 150 and a direction in which the air is discharged may be determined by the at least one wind direction adjuster 160.

The air, when passing from the internal flow path 42 through the first inner guide 140, may be collected from the rear flow path 143 to the inner opening 146 of the front flow path 144, and the air flow may be accelerated while passing through the inner opening 146. After passing through the inner opening 146, the air may swiftly flow into the air discharge grill 108, and the air may be discharged through the air discharge grill 108 to the outside of the air discharge device D.

Embodiments disclosed herein provide an air discharge device with an air discharge grill which may be flexibly manufactured in shape and/or size and an air conditioner having the same.

Embodiments disclosed herein provide an air discharge unit or device installed in an air conditioner to discharge and guide air air-conditioned in the air conditioner to an outside. The air discharge unit may include a first outer body having an air discharging grill part or grill; a second outer body coupled to a side of the first outer body; a third outer body coupled to another side of the first outer body and coupled with the second outer body; a first inner guide having an inner opening facing the air discharge grill part; and a second inner guide coupled with the first inner guide, and together with the first inner guide, forming an internal flow path. The first outer body, the second outer body, and the third outer body may be coupled with one another in a shape of a hollow cylinder. Each of the first outer body, the second outer body, and the third outer body may have an arc-shaped cross section.

The air discharge unit may further include a lower ring connected with at least one of the first inner guide or the second inner guide. The air discharge unit may further include a gear member coupled to the lower ring and having a gear on an outer periphery thereof.

At least one of the first outer body, the second outer body, or the third outer body may have a fitting hole, to which one of the first inner guide or the second inner guide may be inserted and fitted.

The air discharge unit may further include at least one wind direction adjusting member or adjuster rotatably connected to the first inner guide. The first inner guide may include a front flow path part or path having the inner opening therein, the wind direction adjusting member rotatably connected to the front flow path part. The first outer body may have a fitting hole, to which a tip of the front flow path part may be inserted and fitted. The air discharge unit may further include a wind direction adjusting motor that rotates the wind direction adjusting member, and a motor installing part or portion where the wind direction adjusting motor may be installed may be installed in the first inner guide.

The first outer body may further include a first or left detachable part or portion detachably coupled with the second outer body and a second or right detachable part or portion detachably coupled with the third outer body. The first inner guide may include a first or left recess recessed to accommodate the left detachable part and a second or right recess recessed to accommodate the right detachable part.

An outer surface of the second inner guide may face an inner surface of the second outer body and an inner surface of the third outer body. A boundary between the first inner guide and the second inner guide may face an inner surface of the second outer body and an inner surface of the third outer body.

At least one of the first inner guide or the second inner guide may include a top plate part or plate, and a top body may be coupled to the top plate part. The top body may have a through hole, through which an electric wire may pass. The first inner guide may include a rear flow path part or path; a front flow path part or path having the inner opening, the front flow path part being shorter in a lateral or left-right direction than the rear flow path part; and a connecting part or portion that connects the rear flow path part with the front flow path part. The second inner guide may have a semi-circular cross section.

Embodiments disclosed herein provide an air conditioner that may include an air discharge unit or device; an air discharge unit holder that supports the air discharge unit; and a blower to which the air discharge unit holder is mounted, the blower blowing air to the air discharge unit. The air discharge unit may include a first outer body having an air discharge grill part or grill; a second outer body coupled to a side of the first outer body; a third outer body coupled to another side of the first outer body and coupled with the second outer body; a first inner guide having an inner opening that faces the air discharge grill part; and a second inner guide coupled with the first inner guide, and together with the first inner guide, forming an internal flow path. The first outer body, the second outer body, and the third outer body may be coupled with one another in a shape of a hollow cylinder. The first outer body, the second outer body, and the third outer body, each, may have an arc-shaped cross section.

The air discharge unit may further include a lower ring connected with at least one of the first inner guide or the second inner guide and seated in the air discharge unit holder. The air conditioner may further include an air discharge unit rotating mechanism installed in the air discharge unit holder, and the air discharge unit may further include a gear member connected to the lower ring, having a gear on an outer periphery thereof, and rotated by the air discharge unit rotating mechanism.

The air conditioner may further include at least one wind direction adjusting member or adjuster rotatably connected to the first inner guide. The air discharge unit may further include a wind direction adjusting motor that rotates the wind direction adjusting member, and a motor installing part or portion where the wind direction adjusting motor may be installed may be formed in the first inner guide.

At least one of the first inner guide or the second inner guide may include a top plate part or plate. The air discharge unit may further include a top body coupled to the top plate part. The top body may have a through hole through which an electric wire connected to the wind direction adjusting motor may pass.

The first inner guide may include a rear flow path part or path; a front flow path part or path having the inner opening, the front flow path part being shorter in a lateral or left-right width than the rear flow path part; and a connecting part or portion that connects the rear flow path part with the front flow path part. The air discharge unit may further include a lower ring connected with at least one of the first inner guide or the second inner guide and seated in the air discharge unit holder.

According to embodiments disclosed herein the first outer body equipped with the air discharge grill may be coupled with the second outer body and the third outer body into a hollow cylinder shape. Accordingly, the air discharge grill may be manufactured more flexibly in shape and/or size.

Further, as the first outer body and the second outer body and third outer body may be coupled into a hollow cylinder shape, its shape is less likely to deform in comparison to a case in which a single outer body is formed in a hollow cylinder shape. Furthermore, embodiments disclosed herein may minimize a likelihood that air guided to the first inner guide and the second inner guide leaks out to other places than the air discharge grill. Also, the lower ring may firmly secure the first inner guide and the second inner guide, and a lower portion of the air discharge grill may have an increased strength.

An overall air discharge grill may be rotated with a simplified structure, that is, by rotating the gear member. Thus, resistance to the internal flow path may be minimized, allowing for quick air discharge.

Also, the outer body assembly in which the first outer body, the second outer body, and the third outer body may be coupled with one another may be fitted into a fitting hole of the inner guide assembly in which the first inner guide and the second inner guide are coupled with each other, thus providing for easier assembly of the air discharge device.

Additionally, the electric wire connected to the wind direction adjuster motor may be easily wired to an upper portion of the air discharge device, and the electric wire may be safely protected. Furthermore, as the air introduced into the internal flow path may be collected to the front flow path, the air may be forced to flow to the air discharge grill, thus enabling a swift air flow to the air discharge grill.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air discharge device installed in an air conditioner to discharge and guide air air-conditioned in the air conditioner to an outside, the air discharge device comprising:

a first outer body having an air discharge grill;

a second outer body coupled to a first side of the first outer body;

a third outer body coupled to a second side of the first outer body and coupled with the second outer body;

a first inner guide having an inner opening that faces the air discharge grill; and a second inner guide coupled with the first inner guide, and together with the first inner guide, forming an internal flow path, wherein the first outer body, the second outer body, and the third outer body are coupled with one another into a shape of a hollow cylinder, wherein the first inner guide and the second inner guide are coupled with each other into a shape of a hollow cylinder and disposed inside the first outer body, the second outer body, and the third outer body, which are coupled with one another, wherein at least one of the first outer body, the second outer body, or the third outer body has at least one fitting hole into which a tip of one of the first inner guide or the second inner guide is inserted and fitted, such that the first to third outer bodies and the first and second inner guides are fixed to each other to rotate as one body.

2. The air discharge device of claim 1, further including at least one wind direction adjuster rotatably connected to the first inner guide.

3. The air discharge device of claim 2, wherein the first inner guide includes a front flow path portion having the inner opening therein, and the at least one wind direction adjuster is rotatably connected to the front flow path portion.

4. The air discharge device of claim 3, wherein the first outer body has at least one fitting hole, into which at least one tip of the front flow path portion is inserted and fitted.

5. The air discharge device of claim 2, further including at least one wind direction adjuster motor that rotates the at least one wind direction adjuster, wherein a motor installation portion, in which the at least one wind direction adjuster motor is installed, is provided in the first inner guide.

6. The air discharge device of claim 1, wherein the first outer body further includes a first detachable portion detachably coupled with the second outer body and a second detachable portion detachably coupled with the third outer body, and wherein the first inner guide includes a first recess recessed to accommodate the first detachable portion and a second recess recessed to accommodate the second detachable portion.

7. The air discharge device of claim 1, wherein an outer surface of the second inner guide faces an inner surface of the second outer body and an inner surface of the third outer body.

8. The air discharge device of claim 1, wherein a boundary between the first inner guide and the second inner guide faces an inner surface of the second outer body and an inner surface of the third outer body.

9. The air discharge device of claim 1, wherein at least one of the first inner guide or the second inner guide includes a top plate, and a top body coupled to the top plate, and wherein the top body has a through hole, through which an electric wire passes.

10. The air discharge device of claim 1, wherein the first inner guide includes:

a rear flow path portion;

a front flow path portion having the inner opening, wherein the front flow path portion is shorter in a widthwise direction than the rear flow path portion; and a connecting portion that connects the rear flow path with the front flow path.

11. The air discharge device of claim 1, wherein the second inner guide has a semi-circular cross section.

12. The air discharge device of claim 1, further including a lower ring connected with at least one of the first inner guide or the second inner guide.

13. The air discharge device of claim 12, further including a gear member coupled to the lower ring, the gear member having a gear on an outer periphery thereof.

14. An air conditioner, comprising:

at least one air discharge device;

an air discharge device holder that supports the at least one air discharge device; and a blower on which the air discharge device holder is mounted, wherein the blower blows air to the at least one air discharge device, wherein the at least one air discharge device includes:

a first outer body having an air discharge grill;

a second outer body coupled to a first side of the first outer body;

a third outer body coupled to a second side of the first outer body and coupled with the second outer body;

a first inner guide having an inner opening that faces the air discharge grill; and a second inner guide coupled with the first inner guide, and together with the first inner guide, forming an internal flow path, wherein the first outer body, the second outer body, and the third outer body are coupled with one another into a shape of a hollow cylinder, and wherein the first inner guide and the second inner guide are coupled with each other into a shape of a hollow cylinder and disposed inside the first outer body, the second outer body, and the third outer body which are coupled with one another;

an outer cylinder comprising the first outer body, the second outer body, and the third outer body; and an inner cylinder comprising the first inner guide and the second inner guide, wherein the outer cylinder and the inner cylinder are fixed to each other such that the outer cylinder and the inner cylinder rotate as one body, wherein the first inner guide includes a first top plate and the second inner guide includes a second top plate, and wherein the first top plate covers the second top plate and is coupled with the second top plate.

15. The air conditioner of claim 14, wherein the at least one air discharge device further includes at least one wind direction adjuster rotatably connected to the first inner guide.

16. The air conditioner of claim 15, wherein the at least one air discharge device further includes at least one wind direction adjuster motor that rotates the at least one wind direction adjuster, and wherein a motor installation portion, in which the at least one wind direction adjuster motor is installed is provided in the first inner guide.

17. The air conditioner of claim 14, wherein at least one of the first inner guide or the second inner guide includes a top plate, wherein the at least one air discharge device further includes a top body coupled to the top plate, and wherein the top body has a through hole, through which an electric wire connected to the at least one wind direction adjuster motor passes.

18. The air conditioner of claim 14, wherein the first inner guide includes:

a rear flow path portion;

a front flow path portion having the inner opening, wherein the front flow path is shorter in a widthwise than the rear flow path portion; and a connection portion that connects the rear flow path portion with the front flow path portion.

19. The air conditioner of claim 14, wherein the at least one air discharge device further includes a lower ring connected with at least one of the first inner guide or the second inner guide and seated in the air discharge device holder.

20. An air discharge device installed in an air conditioner to discharge and guide air air-conditioned in the air conditioner to an outside, the air discharge device comprising:

a first outer body having an air discharge grill;

a second outer body coupled to a first side of the first outer body;

a third outer body coupled to a second side of the first outer body and coupled with the second outer body;

a first inner guide having an inner opening that faces the air discharge grill; and a second inner guide coupled with the first inner guide, and together with the first inner guide, forming an internal flow path, wherein the first outer body, the second outer body, and the third outer body are coupled with one another into a shape of a hollow cylinder, wherein the first inner guide and the second inner guide are coupled with each other into a shape of a hollow cylinder and disposed inside the first outer body, the second outer body, and the third outer body which are coupled with one another, and wherein the first outer body includes a first detachable portion detachably coupled with the second outer body and a second detachable portion detachably coupled with the third outer body;

an outer cylinder comprising the first outer body, the second outer body, and the third outer body; and an inner cylinder comprising the first inner guide and the second inner guide, wherein the outer cylinder and the inner cylinder are fixed to each other such that the outer cylinder and the inner cylinder rotate as one body wherein the first inner guide includes a first top plate and the second inner guide includes a second top plate, and wherein the first top plate covers the second top plate and. is coupled with the second top plate.

21. The air discharge device of claim 20, wherein at least one of the first outer body, the second outer body, or the third outer body has at least one fitting hole into which one of the first inner guide and the second inner guide is inserted and fitted.

22. The air discharge device of claim 20, further including at least one wind direction adjuster rotatably connected to the first inner guide.

23. The air discharge device of claim 20, wherein an outer surface of the second inner guide faces an inner surface of the second outer body and an inner surface of the third outer body.

24. The air discharge device of claim 20, wherein a boundary between the first inner guide and the second inner guide faces an inner surface of the second outer body and an inner surface of the third outer body.

25. The air discharge device of claim 20, wherein the first inner guide includes:

a rear flow path portion;

a front flow path portion having the inner opening, wherein the front flow path portion is shorter in a widthwise direction than the rear flow path portion; and a connecting portion that connects the rear flow path portion with the front flow path portion.

26. The air discharge device of claim 20, wherein the second inner guide has a semi-circular cross section.

27. The air conditioner in which the air discharge device of claim 20 is installed.

* * * * *